US006699803B2

(12) United States Patent
Muirhead

(10) Patent No.: US 6,699,803 B2
(45) Date of Patent: Mar. 2, 2004

(54) CAMOUFLAGE COVERING AND METHOD OF MANUFACTURE

(76) Inventor: Todd A. Muirhead, 1743 Rhonda La., Stone Mountain, GA (US) 30087

( * ) Notice: Subject to any disclaimer, the term of this patent is extended or adjusted under 35 U.S.C. 154(b) by 0 days.

(21) Appl. No.: 10/160,866

(22) Filed: Jun. 3, 2002

(65) Prior Publication Data

US 2002/0152559 A1 Oct. 24, 2002

Related U.S. Application Data

(62) Division of application No. 09/590,651, filed on Jun. 8, 2000, now Pat. No. 6,500,214.

(51) Int. Cl.[7] ..... D04H 1/00

(52) U.S. Cl. ..... 442/2; 442/50; 442/79; 442/86; 442/136; 442/185; 442/186; 442/366; 442/369; 428/919; 2/94; 2/455; 2/458; 2/900

(58) Field of Search ..... 442/2, 50, 79, 442/86, 136, 185, 186, 366, 369; 428/919; 2/94, 455, 456, 900

(56) References Cited

U.S. PATENT DOCUMENTS

| | | | | |
|---|---|---|---|---|
| 1,817,871 A | | 8/1931 | Brandt | |
| 2,278,898 A | | 4/1942 | Schofield | |
| 2,351,142 A | | 6/1944 | Mitchell | |
| 2,354,765 A | | 8/1944 | Meyer et al. | |
| 2,364,289 A | | 12/1944 | Hale | |
| 3,899,620 A | * | 8/1975 | Roeloftzen | 428/112 |
| 4,106,124 A | | 8/1978 | Green | |
| 4,837,056 A | | 6/1989 | Easley | |
| 5,274,848 A | | 1/1994 | Shamblin | |
| 5,281,460 A | | 1/1994 | Cox | |
| 5,347,659 A | | 9/1994 | Tibljas | |
| 5,560,971 A | | 10/1996 | Emery | |

* cited by examiner

*Primary Examiner*—Ula C. Ruddock
(74) *Attorney, Agent, or Firm*—Barry Kaplan Myers & Kaplan

(57) ABSTRACT

Camouflage covering fabricated by the method of attaching dyed jute strands to netting, wherein the netting is placed over an individual or object to be camouflaged. The covering may be formed as an integral garment, such as a hooded poncho, or may be attached to clothing such as a battle dress uniform (BDU) to form a ghillie suit. The covering may be draped over an object such as a weapon, vehicle, equipment, or supplies. The present invention allows for quick, cost-effective creation of realistic three-dimensional camouflage coverings and apparel that are easily portable, naturally frayed in appearance, and securely assembled without the use of loops or snaps.

12 Claims, 4 Drawing Sheets

CAMOUFLAGE COVERING AND METHOD OF MANUFACTURE

RELATED APPLICATIONS

This application is a division of application Ser. No. 09/590,651 filed on Jun. 8, 2000, now issued as U.S. Pat. No. 6,500,214 with an issue date of Dec. 31, 2002, and claims priority based thereupon.

TECHNICAL FIELD

The present invention relates generally to camouflaging and, more specifically, to a multi-use camouflage covering and method of manufacture.

BACKGROUND OF THE INVENTION

Many settings such as hunting and military operations require the use of camouflage clothing and coverings to assist the user from being detected by an animal, opponent, or adversary. Camouflage covering is utilized not only to disguise individuals, but is often used to cloak supplies, equipment, vehicles, weapons, and the like.

The most advantageous concealment apparel possesses a natural, three-dimensional camouflage effect. Such a disguise efficiently blends with background objects and foliage to obscure the wearer or the covered object, making him or it imperceptible to the observer.

Many attempts have been made to design a suitable and effective camouflage covering. Examples of such camouflage s covers may be found by reference to U.S. Pat. No. 1,817,871 to Brandt; U.S. Pat. No. 2,278,898 to Strathmore; U.S. Pat. No. 2,351,142 to Mitchell; U.S. Pat. No. 2,354,765 to Meyer et al.; U.S. Pat. No. 2,364,289 to Hale; U.S. Pat. No. 4,106,124 to Green; U.S. Pat. No. 5,274,848 to Shamblin; U.S. Pat. No. 5,281,460 to Cox; and, U.S. Pat. No. 5,347,659 to Tibljas. In view of the present invention, however, these devices are seen to be variously disadvantageous.

U.S. Pat. No. 2,278,898, for example, discloses a three-dimensional alternative configuration assembled on a wire base. This type of camouflage covering is constructed of teased and dyed steel wool secured to a base of chicken wire. While a marginally effective three-dimensional screen, the wire-type construction poses a hindrance to portability.

U.S. Pat. No. 5,281,460 discloses strips of nylon attached to a mesh base designed to be worn as a poncho. The strips are sewn or glued at one end and the other end swings freely. One disadvantage of the sewing attachment method is the time involved in sewing each individual strip to the mesh base. While gluing may be faster, glued strips are likely not held as securely as sewn strips; thus, an advantage saved in time may be offset by the disadvantage of potential strip loss. Another disadvantage is the strips themselves. The strips are formed from pieces of fabric which have a tendency to bunch up in use; thereby, allowing the wearer to be distinguished from his surroundings. In the past, this disadvantage has been endured with the belief that through repeated usage, the edges will begin to fray creating a more realistic look. However, using a disguise that is not realistic, even for a limited period of time, may be unacceptable in many situations.

An alternative variation, described in U.S. Pat. No. 5,274,848, utilizes a base of traditional camouflage battle dress uniform (BDU) in lieu of mesh. This provides a more comfortable disguise; however, the patented device uses snaps to attach bound and fringed strips to the underlying BDU. Unfortunately, snaps may become disengaged if pulled inadvertently, dented from use and no longer able to close properly; and/or pull free of the base fabric creating a hole therein and necessitating repair. Furthermore, the form of the bound and frayed strips is seen to be disadvantageous in appearance, in that coverage by the frayed portions may not be adequate in length, distribution, or orientation.

U.S. Pat. No. 5,347,659 describes a ghillie suit, wherein the disadvantage of high cost is lessened through a self-described easy and efficient method of manufacture. The suit is constructed on a camouflage base with a matrix of loop members mounted thereon. The loop members are intended to serve the same function as the previously discussed strips. The reported advantage of easy manufacture may be achieved by the method of attachment, that is, gluing or sewing the loops to the base web. However, the same attachment method that saves time creates disadvantages. The attached looping design prevents the fabric from fraying. This inhibits the realistic nature of the disguise. Furthermore, loops inherently hook around and catch on surrounding branches and brush. These disadvantages directly effect the successful concealment of an individual.

It is, therefore, readily apparent that there is a need for camouflage covering and apparel which will allow for quick, cost-effective creation of realistic three-dimensional camouflage covering that is easily portable, naturally frayed in appearance, and securely assembled without the use of loops or snaps; thus, preventing the above-discussed disadvantages.

BRIEF SUMMARY OF THE INVENTION

Briefly described, in a preferred embodiment, the present invention overcomes the above-mentioned disadvantages, and meets the recognized need for such a device, by providing an apparatus and method of manufacture which will allow for quick, cost-effective creation of realistic three-dimensional camouflage covering and apparel that is easily portable, naturally frayed in appearance, and securely assembled without the use of loops or snaps.

According to its major aspects and broadly stated, the present invention in one embodiment is camouflage covering fabricated by the method of tying strands of jute, in the form of twine or thread, to netting. The netting may be formed into an integrally formed garment, such as a poncho, or may be overlaid or attached to clothing or common military camouflage uniforms.

In one form, the present device can be overlaid on a coat and/or pants, such as a battle dress uniform (BDU). Preferably, an additional piece of camouflage fabric is attached to the back outer shoulder surface of the BDU coat to provide a face flap, or hood. Fabric netting is placed on the exterior surface of the BDU and face flap, and is trimmed to cover the face flap and fully surround the arm, leg and torso regions.

Forming a grid-like pattern covering the suit, the netting is preferably sewn to the BDU with non-scented waxed dental floss, and secured to the BDU at each net corner knot. Preferably, an adhesive is applied over the sewn knots to further secure the attachment.

Preferably, four to eight pounds of jute strand is cut to lengths of 18 to 24 inches. The strands may be dyed at this stage, or, alternatively, may be dye-processed in full garment form, as described more fully below. Dye colors are chosen to best approximate the brush, terrain, and season of the ghillie suit's intended use. A preferred camouflage color arrangement includes four colors, with approximately twothirds of the cut jute strand dyed a predominant base color, and the remaining cut jute strand, in preferably even proportions, dyed in three accessory colors.

Small groups of base color jute strand cuttings, preferably four to five strands, are tied to one side, or to each of the four sides, of each net square on the grid that is sewn and glued to the BDU. Preferably, each jute strand grouping is tied at the midpoint of either one side or of each of the four sides of each net square. Preferably, each jute strand grouping is aligned and each knot is centered so as to create equal hanging lengths. After the entire suit is covered with the base color jute strand cuttings in the aforementioned arrangement, the accessory color jute strand cuttings may be added.

The accessory color jute strand cuttings are tied to the net squares on the grid that is sewn and glued to the BDU, to which the base color jute strand cuttings are tied. The arrangement of the accessory color jute strand groupings is variable with respect to the base color jute strand cuttings. Preferably, each accessory color jute strand grouping is aligned and each knot is centered so as to create equal hanging lengths. Each accessory color jute strand grouping is tied adjacent to a base color jute strand grouping on one of the four sides of a net square until adequate coverage and overall color variation is obtained.

In another embodiment of the present invention, a netting is formed into an integrally formed garment, such as a hooded poncho. Advantageously of this form, the front torso portion may be removed along the lower sleeve seam line, resulting in a poncho-style ghillie suit adapted for use in crawling along the ground. A similar effect can, of course, be had with the BDU-attached ghillie suit.

The process of the present invention further provides that the jute strands may be attached in their natural color, and dyed at a later stage in the assembly. In such alternative dying process, the entire device is dyed with a base color and allowed to dry. Subsequently, various other colors are sprayed on the garment, in random fashion or according to a preferred pattern, in order to achieve the desired camouflage appearance.

Other embodiments of the device of the present invention are contemplated wherein the base net is cut and dimensioned to cover various sized objects such as a weapon, a foxhole, a vehicle, or the like.

Thus, an object, feature, and advantage of the present invention is to provide a camouflage covering or ghillie suit which is quickly and cost-effectively fabricated.

Another object, feature, and advantage of the present invention is to provide a realistic three-dimensional camouflage covering or ghillie suit.

Yet another object, feature, and advantage of the present invention is to provide a naturally frayed camouflage covering or ghillie suit through the use of jute strand.

Still another object, feature, and advantage of the present invention is to provide a camouflage covering or ghillie suit that may be trimmed for a custom fit.

Yet still another object, feature, and advantage of the present invention is to provide a camouflage covering or ghillie suit that is securely assembled without the use of snaps.

Another and further object, feature, and advantage of the present invention is to provide a poncho-style ghillie suit without a front torso region that is suitable for crawling on the ground.

Still another and further object, feature, and advantage of the present invention is to provide a camouflage covering or ghillie suit that is light weight, comfortable to wear, and convenient to fold and roll for insertion into a backpack or other carrying container.

Yet still another and further object, feature, and advantage of the present invention is to provide a method of quickly and cost-effectively creating camouflage covering and ghillie suits.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred Embodiment with reference to the accompanying drawing Figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar function or functions.

Referring now to FIGS. 1–4, the present invention is a camouflage covering 10, generally comprising net base 20 and a plurality of jute strands 40, wherein camouflage covering 10 may be shaped, formed, and/or cut into any desired shape. Jute strands 40 are of forms such as twine or thread, rather than woven burlap forms often utilized in the prior art.

Figure 1:
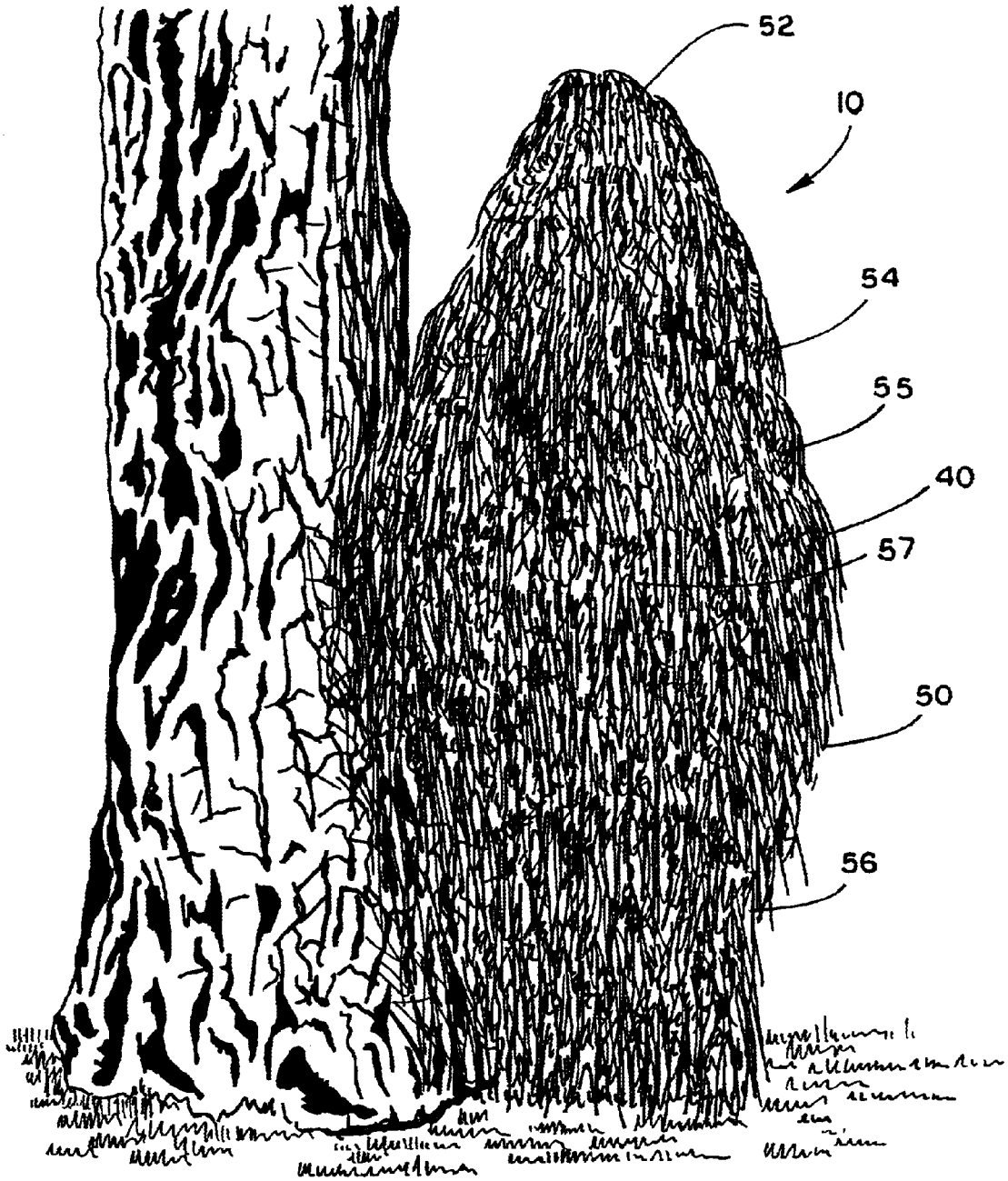
FIG. 1 is a perspective view of the ghillie suit of the present invention, wherein the suit is shown worn by an individual in a natural environment.
Figure 2:
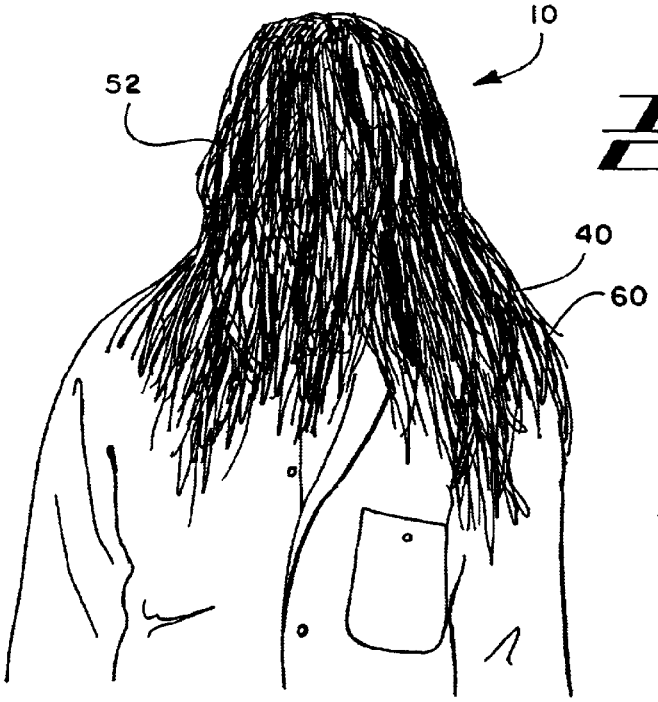
FIG. 2 is a perspective view of the ghillie suit hood of the present invention, wherein the hood is worn by an individual, according to an alternate embodiment of the present invention.
Figure 3:
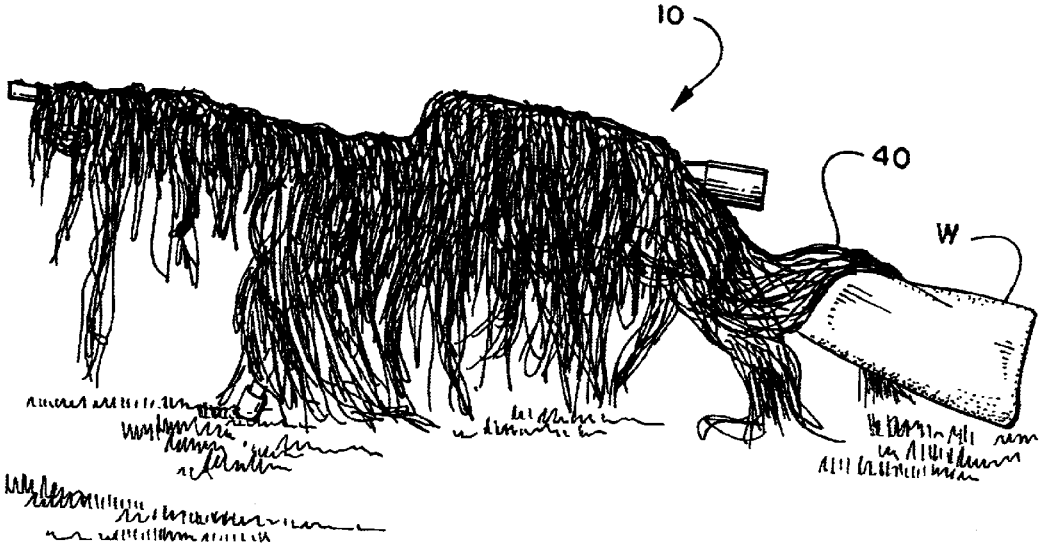
FIG. 3 is a perspective view of a camouflage covering of the present invention, wherein the covering is draped over a rifle, according to an alternate embodiment of the present invention.

In one form, camouflage covering 10 is formed as, or attached to, a garment to form a ghillie suit 50 or a ghillie hood 60, respectively, as shown in FIGS. 1 and 2. In an alternate form, FIG. 3 shows camouflage covering 10 shaped to cover a weapon W.

Figure 4A:
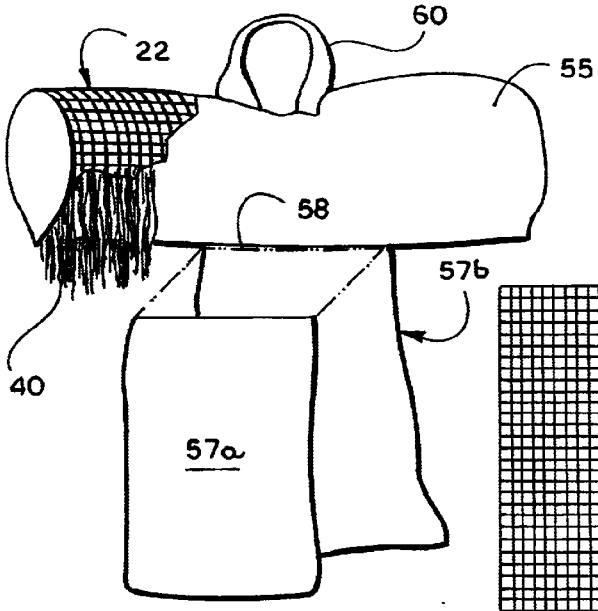
FIG. 4A is a perspective view of a poncho-style ghillie suit of the present invention, and, further, showing a removable front torso portion, according to alternate embodiments of the present invention.
Figure 4B:
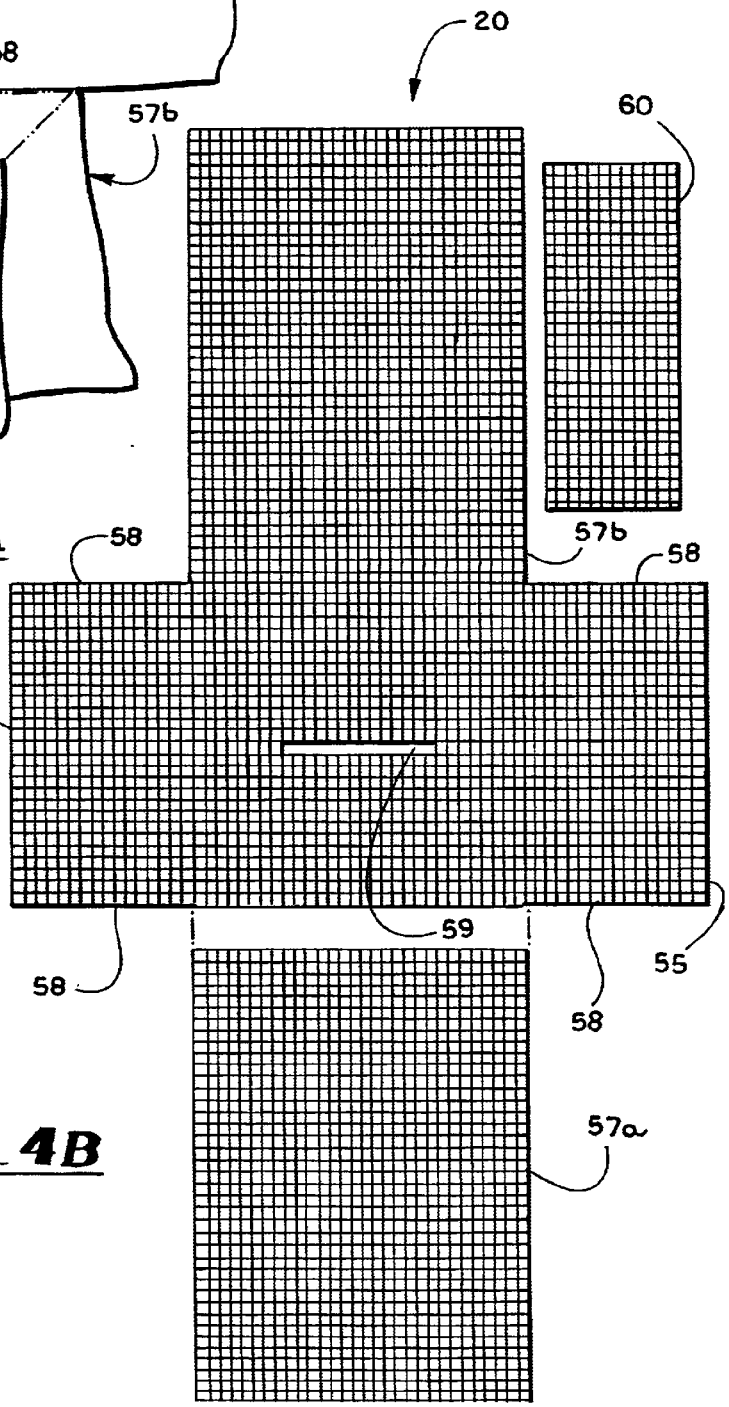
FIG. 4B is an elevation view of a pattern for the production of a poncho-style ghillie suit of the present invention, also showing the removable front torso portion, according to alternate embodiments of the present invention; and, FIG. 4C is a plan view of a cutaway of the base netting of the present invention, wherein jute twine groupings have been tied according to a preferred embodiment of the invention.
Figure 4C:
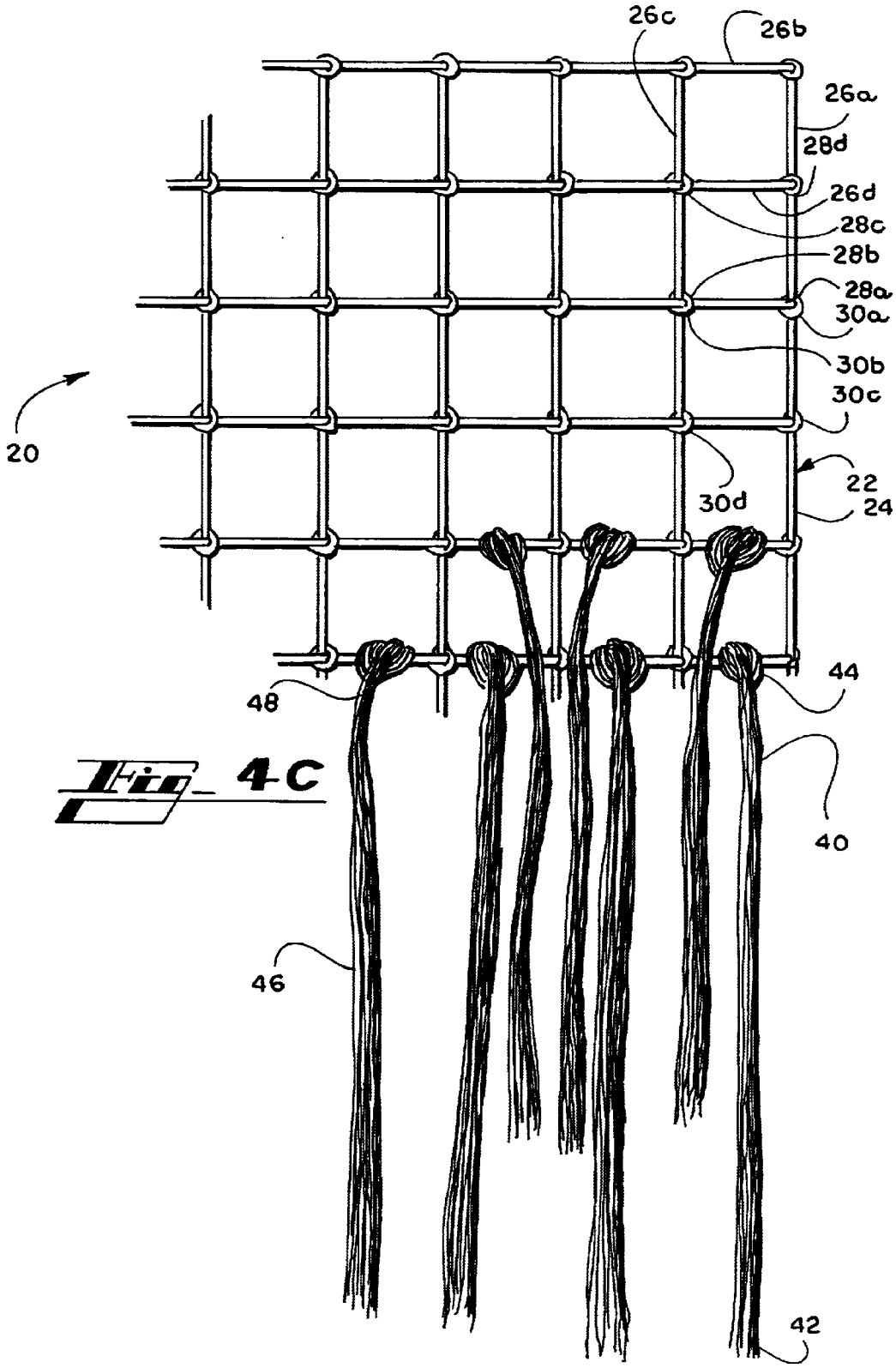

More specifically, and as best seen through reference to FIG. 4C, net base 20 provides a grid-type structure 22 comprising a plurality of net squares 24 consecutively linked together. Each net square 24 preferably has a first side 26*a*, a second side 26*b*, a third side 26*c*, a fourth side 26*d* and four corners 28*a*, 28*b*, 28*c*, 28*d*, with each corner having a knot 30*a*, 30*b*, 30*c*, 30*d*, respectively. One skilled in the art, however, will recognize that knots 30*a*, 30*b*, 30*c* and 30*d* are not necessary for the functioning of the present device; each corner 28*a*, 28*b*, 28*c*, 28*d* of each net square 24 may be joined by any means known within the art.

Jute strands 40 each have end 42 and midpoint 44. According to one process of fabrication of the present invention, jute strands 40 are dyed to mimic various environmental color schemes. Preferably, a majority portion of jute strands 40 are dyed a base color and three minority portions of jute strands 40 are dyed accessory colors. A second preferred process for dying the jute strands will be discussed below in greater detail.

Camouflage covering 10 is fabricated by tying small groups 46 of base color jute strands, preferably four to five strands per group, to sides 26*b* and 26*d* of net square 24, or to each of the four sides 26*a*, 26*b*, 26*c*, 26*d* of each net square 24. The location and population of the strand groups 46 is dependent upon the desired coverage for the area underlying the strands. For example, in areas that are anticipated to hang vertically, sufficient coverage may be obtained by lower populations of strand groups 46, as at 26*b* and 26*d* of net square 24. For areas in which additional coverage is required, such as any region where it is anticipated that an underlying vertical surface will transition to a horizontal surface (e.g., as in shoulder regions of a garment, or the like), sufficient coverage may be obtained by increasing populations of strand groups 46, as at 26*a*, 26*b*, 26*c*, 26*d* of each net square 24.

Preferably, each base color jute strand grouping 48 is tied centrally between net corners 28*a*, 28*b*, 28*c*, 28*d*. Preferably, each small group 46 of jute strands is aligned and tied at midpoint 44 so as to create ends 42 with equal hanging lengths. After a small group 46 of base color jute strands is tied to sides 26*b* and 26*d* of net square 24, or to each of the four sides 26*a*, 26*b*, 26*c*, 26*d* of each net square 24, accessory color jute strands are added. Small groups 46 of accessory color jute strands, preferably four to five strands, are tied to net squares 24, to which small groups 46 of base color jute strands are tied.

Preferably, each accessory color jute strand grouping is tied to one of the four sides 26*a*, 26*b*, 26*c*, 26*d*, adjacent to a base color jute grouping. The arrangement of the accessory color jute groupings is variable with respect to the base color jute cuttings and the overall color variation desired. Additional jute groupings 46 are added in like manner until desired coverage is obtained.

Ghillie suit 50, in one preferred form, may be fabricated upon a base of camouflage coat and pants, an example of which is well-known in the art as a battle dress uniform (BDU). BDUs have outer surface 54, arm region 55, leg region 56, and torso region 57. Preferably, as shown in FIG. 2, an additional piece of camouflage fabric is attached to BDU coat outer surface 54 to provide face flap or hood 60. Net base 20 is placed on the BDU outer surface 54 and is trimmed to cover face flap 52 and to fully surround arm 55, leg 56 and torso 57 regions. Net base 20 is preferably sewn to BDU outer surface 54, securing each corner knot 30 or, alternatively, each corner 28. Preferably, non-scented waxed dental floss is used for sewing. One skilled in the art, however, will recognize that alternative type sewing material may also be used. Preferably, an adhesive is applied over the sewn portion to further secure the attachment. A preferred adhesive, sold under the trademark SHOE GOO may be used. Again, one skilled in the art will recognize that alternative adhesive may also be used. One skilled in the art further will recognize that other means may be utilized to attach net base 20 to the BDU such as, for exemplary purposes only, clips, snaps, buttons, pins and the like.

Ghillie suit 50 is completed by the same fabrication method as camouflage covering 10, wherein small groups 46 of jute strands are tied to each net square 24, according to the aforementioned arrangement.

In an alternative embodiment, ghillie suit 50 may be constructed with net base 20 glued to BDU outer surface 54, in lieu of sewn and glued, so as to provide a quicker means of fabrication.

In an alternative embodiment, netting 24 is formed into an integrally formed garment, such as a hooded poncho. A pattern for this embodiment is seen in FIG. 4B. In this form, a square of netting is cut to dimensions appropriate to the size of ghillie suit required. The corners are removed. As shown in FIG. 4B, a corner, so removed, may be reused in forming a hood 60 for attachment along the slit 59 provided as a head opening within the netting. So patterned, the edges are attached along adjacent regions to form a poncho-style garment.

Advantageously of this form, the front torso portion 57*a* may be removed along the lower sleeve seam line 58, resulting in a poncho-style ghillie suit adapted for use in crawling along the ground. A similar effect can, of course, be had with the BDU-attached ghillie suit. In this form, the garment is lighter, more susceptible of rolling or folding into a compact form for ease of storage and portability, and is less likely to snag during ground-based operations.

In an alternate embodiments, ghillie hood 60 may be fabricated on a base of camouflage helmet or a hat following the aforementioned method of assembly.

In additional alternate embodiments, net base 20 is cut or formed to sufficiently cover a plurality of objects such as, for exemplary purposes only, rifle 80 (as shown in FIG. 3), other weapons, equipment, vehicles, or the like.

It should be noted that, although one embodiment disclosed hereinabove attaches net base 20 to a BDU type outfit, it is contemplated that any outfit may be used. Additionally, net base 20, formed of any preferred shape and/or size, simply may be draped over an individual without attaching to his clothing.

As briefly stated above, the process of the present invention further provides that the jute strands may be attached to the netting in their natural color, and dyed at a later stage in the assembly. In such alternative dying process, the entire netting and strand assembly is dyed with a base color and allowed to dry. Subsequently, various other colors are sprayed on the garment, in random fashion or according to a preferred pattern, in order to achieve the desired camouflage appearance.

It is further noted that the jute strands may be chemically treated to provide for waterproofing or water resistance of the finished product, to provide fixatives to enhance the bonding and application of the dyes, and/or to provide for fire resistance or fire retardant characteristics in the finished product.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A camouflage covering comprising: a net base and a plurality of strands in the form of twine or thread carried by said base, said strands having a first end, a second end, and a midpoint, with at least one of said first and second ends remaining unattached, wherein said strands are affixed to the net base via knotting of the strands thereon, wherein said strands are proximately arranged to provide a camouflage screen.

2. The camouflage covering of claim 1, wherein said strands are of jute.

3. The camouflage covering of claim 1, wherein said strands are attached to said net base with said first and second ends remaining unattached.

4. The camouflage covering of claim 3, wherein said strands are attached at said midpoint.

5. The camouflage covering of claim 1, wherein said net base is formed in square sections having a first side, a second side, a third side and a fourth side, thereby defining a first corner, a second corner, a third corner and a fourth corner.

6. The camouflage covering of claim 5, wherein said strands are attached along at least one of said sides of said square section.

7. The camouflage covering of claim 1, wherein said strands are treated to provide water resistant characteristics.

8. The camouflage covering of claim 1, wherein said strands are treated to provide flame retardant characteristics.

9. The camouflage covering of claim 1, wherein said strands are treated with a fixative to enhance a coloring process.

10. The camouflage covering of claim 1, wherein said strands are colored.

11. The camouflage covering of claim 10, wherein said strands are colored according to the process steps of:

(a.) coloring said camouflage covering with a base color; and, (b.) coloring selective portions of said camouflage covering by applying an alternate color thereto.

12. The camouflage covering of claim 11, wherein said alternate color is applied by a spraying process.

* * * * *